US005913345A

United States Patent [19]

Corrado et al.

[11] Patent Number: 5,913,345

[45] Date of Patent: Jun. 22, 1999

[54] WRAP-LIMITING SHEET CLEANER FOR THIN SUBSTRATES

[75] Inventors: Frank C. Corrado; James W. Fisher, both of Rochester; Gary R. Larsen, Webster; Ronald W. Sweet, Conesus, all of N.Y.

[73] Assignee: Seratek, LLC, Livonia, N.Y.

[21] Appl. No.: 08/940,826

[22] Filed: Sep. 30, 1997

Related U.S. Application Data

[60] Provisional application No. 60/027,622, Oct. 4, 1996.

[51] Int. Cl.[6] ..... B08B 11/00

[52] U.S. Cl. ..... 15/3

[58] Field of Search ..... 15/3, 100, 102, 15/104.002; 271/188

[56] References Cited

U.S. PATENT DOCUMENTS

| | | | |
|---|---|---|---|
| 4,009,047 | 2/1977 | Lindsay | 134/9 |
| 4,982,469 | 1/1991 | Nishiwaki | 15/3 |
| 5,349,714 | 9/1994 | Korbonski et al. | 15/3 |

FOREIGN PATENT DOCUMENTS

| | | | |
|---|---|---|---|
| 57-108973 | 7/1982 | Japan | 15/3 |
| 4-32456 | 2/1992 | Japan | 271/188 |
| 5-162916 | 6/1993 | Japan | 271/188 |

*Primary Examiner*—Mark Spisich
*Attorney, Agent, or Firm*—M LuKacher; R C Brown

[57] ABSTRACT

A system for conveying sheets of thin substrate having low sheet stiffness while controlling and limiting the angle of wrap of the substrate on the roller, and a sheet cleaning apparatus employing the wrap-limiting system. A substrate conveyance roller is provided with a plurality of circumferential grooves spaced along the roller. Into each groove is disposed a substrate guide in near-tangential relationship with the surface of the roller at the point on the roller where stripping of the substrate from the roller surface is desired. In a preferred embodiment of a wrap-limiting system in accordance with the invention, one or more substrate guides are provided which extend through the grooves both upstream and downstream of the roller along the substrate conveyance path. The points at which the guide enters and leaves the groove define and limit the wrap angle assumable by the substrate on the roller. The invention is useful in conveying thin substrates on grooved conventional rollers as well as in cleaning thin substrates by contact cleaning rollers. A substrate cleaning system employing the invention includes first and second contact cleaning rollers, each preferably opposed by a backing roller, the substrate to be cleaned passing through the nip. Each CCR is provided with grooves and guides which are axially offset between the two rollers so that no portion of the substrate passes uncleaned.

15 Claims, 10 Drawing Sheets

WRAP-LIMITING SHEET CLEANER FOR THIN SUBSTRATES

This application claims in part the priority benefit of our provisional application Ser. No. 60/027622 filed Oct. 4, 1996.

DESCRIPTION

The present invention relates to a system for controlling and limiting the wrapping of thin, flexible substrates on a roller, and more particularly to a system for cleaning surfaces of such substrates by the rolling contact of a cleaning roller on the substrate.

A system provided by the invention is especially suitable for removal of particles from discontinuous substrates, i.e., sheets, which can be an important step in many manufacturing processes, for example, the printing or photolithography of posters, automotive parts, etc. The term "substrate" as used herein means a sheet stock having one or more substantially planar surfaces. The sheet stock may be substantially rigid or may be flexible into an arc or other curve and may comprise discontinuous sheets or continuous web. Such substrates usually wrap and cling to a roller because of electrostatic attraction.

A roller having a surface comprising one or more of various resiliently compressible organic polymers, and especially including a polyurethane, can be very effective in removing particles from a substrate surface when in contacting relationship with the surface to be cleaned of particles. The roller surface exhibits a tacky behavior when contacting the surface as if adhesive, although there is no adhesive material present on the roller. As the roller rolls over the surface, particles on the surface find greater attraction to the roller surface than to the substrate surface and become transferred thereto. These rollers are known as "particle transfer rollers," or PTRs, and also as "contact cleaning rollers," or CCRs. For convenience, cleaning rollers used in the system of this invention are referred to herein as CCRs without limitation to the mechanisms of particle adherence or tackiness operative therein. A cleaning roller may also be a roller having a surface which is physically tacky with respect to the surface being cleaned.

Substrates may be divided generally into two types: continuous (webs) and discontinuous (sheets). Webs are readily cleaned by passing the substrate through the nip between a CCR and a backer roller, as disclosed, for example in U.S. Pat. No. 5,251,348 to Corrado. Even ultra-thin webs, for example, webs less than 0.001" in thickness, can be cleaned by such apparatus without difficulty. The web is drawn through the apparatus under tension. Being continuous, it has no free leading edge.

A serious problem arises, however, when one attempts to clean thin, flexible sheets having very low sheet stiffness, particularly but not exclusively sheets formed of plastic material which can be active electrostatically, such as (but not limited to) polyester, polyolefin, polyamide, polysulfone, saran, polyvinylchloride, and polycarbonate. A tacky roller sheet cleaner including a CCR having a shell of polyether urethane coated with a thin outer layer of polyurea urethane elastomer is disclosed, for example, in U.S. Pat. No. 4,009,047 to Lindsay. A substrate having low sheet stiffness can be attracted to the surface of a CCR generally over the entire surface and undesirably remain in contact with the roller as the substrate leaves the cleaning nip, rather than continue in its desired direction out of the nip and away from the CCR. A related problem is that a loosely-adhered coating on a relatively stiff substrate may tend to follow the curve of the CCR surface and thus be stripped from the substrate.

Thin, flexible sheets can also be difficult to convey on conventional rollers along a conveyance path. Again, the electrostatic nature of many sheet materials (their tendency to become electrostatically charged) can cause the leading edge of the sheet to fail to free itself from the roller at the proper point, and the sheet may become undesirably and unacceptably wrapped around the roller.

One approach in addressing these problems in a sheet cleaner is disclosed in U.S. Pat. No. 5,349,714 to Korbonski et al. wherein the CCR is provided with a pair of circumferential grooves formed in the cleaning surface near the outboard edges of the sheet path. Endless belts are reeved about pulleys and are received in the grooves. As the substrate is passed through the cleaning nip, the belts keep the sheet from adhering to the cleaning roller. A second such cleaning roller downstream from the first and offset axially from the first serves to insure that all areas of the substrate surface are cleaned by contact with at least one cleaning roller. Additional sets of belts between the belts at the edges can be included as required for a particular application.

Use of belts to prevent adherence of substrates to CCRs gives rise to two disadvantages. First, the apparatus is made more complex, cumbersome, and expensive to build and maintain by the additional shafts, pulleys, motors, gearing, and controls required to drive the belts synchronously with the CCRs. Second, and perhaps of greater importance, is that driven belts tend to be particle generators themselves, slowly and continuously shedding debris into their surroundings as they wear, which is not a desirable characteristic for a facility dedicated to removing particles. An additional disadvantage is lowered versatility of web guidance, as described hereinbelow.

Thus there exists a need for a simple mechanism for reliably limiting the angle of wrap which a substrate may assume on a roller conveying the substrate. Further, there exists a need for a mechanically simple substrate cleaner which can clean at least one surface of a sheet substrate by rolling contact with a contact cleaning roller, while preventing, without selfcontamination, the substrate from becoming wrapped on the cleaning roller.

It is a principal object of the invention to provide an improved system for conveying thin sheet substrates by rollers which limits the wrap angle of a sheet on a roller by stripping the sheet from the roller at a predetermined point.

It is a further principal object of the invention to provide an improved system for cleaning particles from sheet substrates while preventing such substrates from becoming wrapped on a cleaning roller of the system.

It is a further object of the invention to provide an improved system for cleaning particles from sheets less than 0.001-inch in thickness.

It is a still further object of the invention to provide an improved system for cleaning particles from sheets which system can also turn a flexible substrate through an arc of up to 180°.

It is a still further object of the invention to provide an improved system for cleaning particles from sheet substrates using stationary, non-contaminating means to prevent the sheets from becoming wrapped on a cleaning roller of the system.

Briefly described, a system for conveying sheets of thin substrates having low sheet stiffness includes a conveyance roller provided with a plurality of circumferential grooves spaced along the roller. Into each groove is disposed a substrate guide in near-tangential relationship with the surface of the roller at the point on the roller where stripping of the substrate from the roller surface is desired. A substrate cleaning system employing the invention includes a first contact cleaning roller rotatably mounted in a frame, the CCR being in or near contact with an opposing collinear backer roller also rotatably mounted in the frame, the juncture of the two rollers defining a nip therebetween, the nip being oriented substantially orthogonal to the path of a sheet substrate passing through the nip. The CCR is provided with at least one circumferential groove in its peripheral surface, preferably a plurality of spaced-apart grooves, and a fixed substrate guide or guides in the groove or grooves at a location beyond or downstream of the nip where it is desired to lift the sheet from the surface of the CCR. This may be immediately after the nip, if the sheet is to be directed onward in generally the same direction as the entering direction, or it may be at any desired angle of rotation of the CCR beyond the nip up to about 180°. Thus the attraction of a substrate to a CCR may be used to advantage to turn the sheet and send it in a direction different from the entering direction. The invention is useful in conveying thin substrates on conventional rollers as well as in cleaning thin substrates on contact cleaning rollers. As used herein, the term "roller" means any rotatable cylindrical object having a surface over which a substrate passes in rolling contact.

Any of several means may constitute the fixed substrate guide; for example, it can be a mechanical finger extending into the groove, preferably with its upper surface substantially tangential to the roller surface, or it can be an air jet blown from a fixed tube laid in the groove and supplied with pressurized air, or it can be a radial orifice in the bottom of the groove wherein the roller is a baffled hollow roller the interior of which is supplied through a rotating coupling with pressurized air. Other means of lifting the sheet from the roller at a given rotational point from the nip may be recognized by persons skilled in the art and are within the scope of the invention.

Because a grooved CCR will leave longitudinal portions of the substrate not cleaned, a second grooved CCR and backer roller may be beneficially provided immediately downstream of the first CCR, the grooves in the second CCR being offset (inopposed) from those in the first CCR to complete the cleaning of the substrate. The second CCR has grooves and substrate guides substantially identical with those of the first CCR.

In a preferred embodiment, frame portions supporting the CCRs are longitudinally rotatable on a fixed frame so that the CCRs are readily pivoted into and out of the substrate conveyance path and are removable for servicing and cleaning as needed. One or both of the CCRs or backer rollers may be driven by conventional means to draw the sheet substrates through the nips of the system.

In a preferred embodiment of a wrap-limiting conveyance roller in accordance with the invention, one or more substrate guides are provided which extend through the grooves both upstream and downstream of the roller along the substrate conveyance path. The points at which the guide enters and leaves the groove define and limit the wrap angle assumable by the substrate on the roller.

The foregoing and other objects, features, and advantages of the invention, as well as presently preferred embodiments thereof, will become more apparent from a reading of the following description in connection with the accompanying drawings in which.

Figure 1:
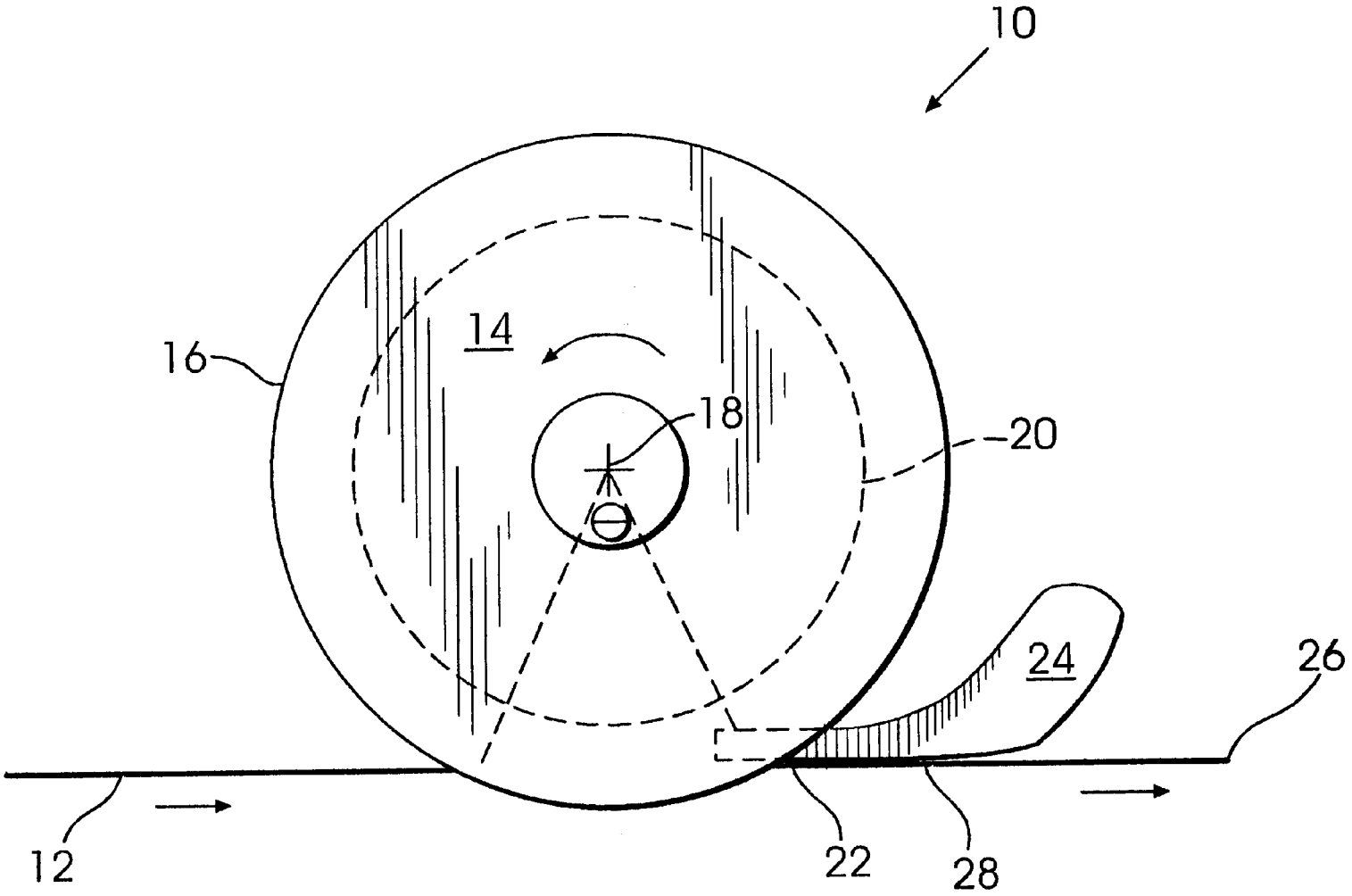
FIG. 1 is an elevational view, partially cross-sectional, of a wrap-limiting conveyance roller system in accordance with the invention.
Figure 2:
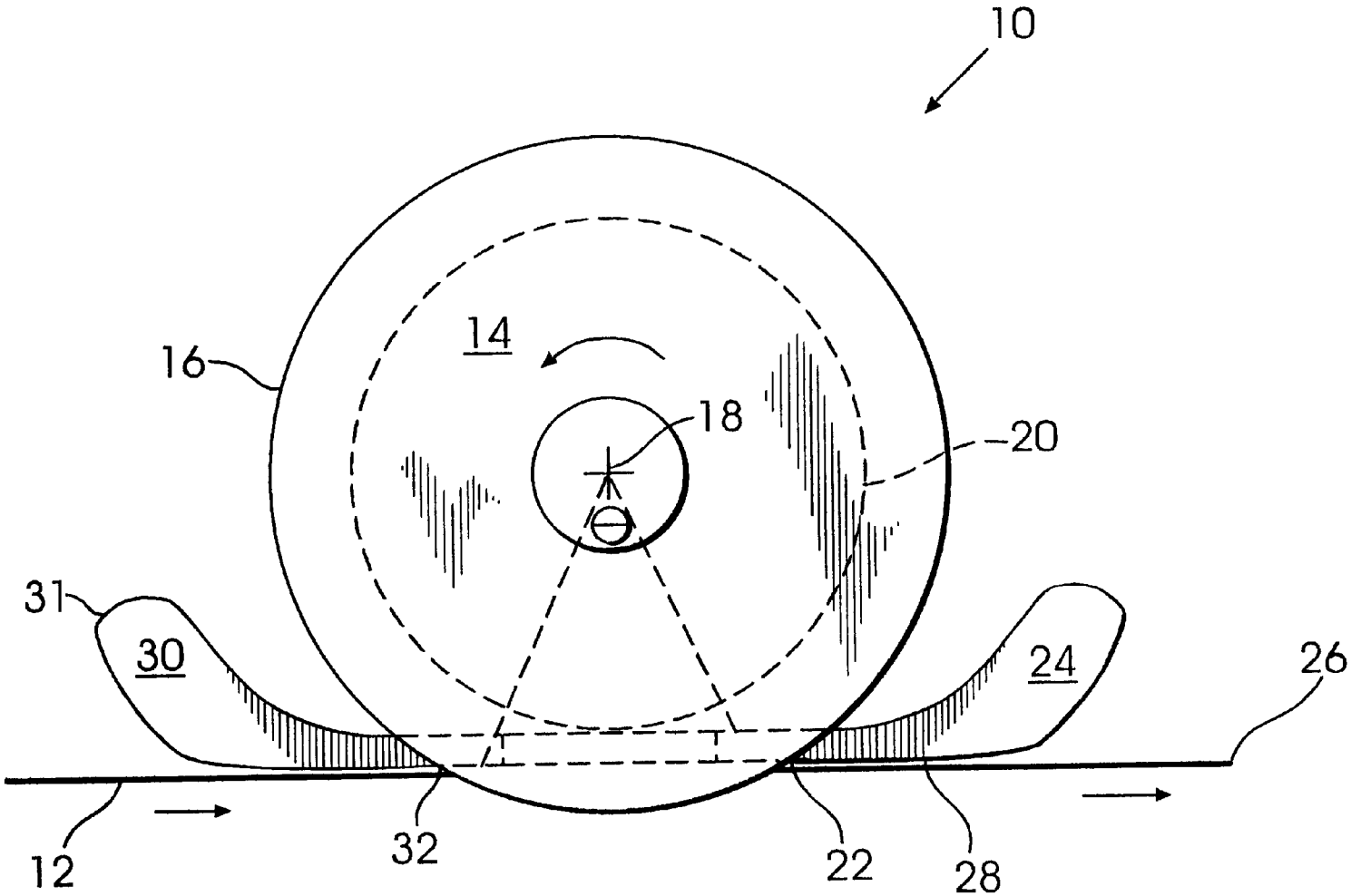
FIG. 2 is a further embodiment of the system shown in FIG. 1, showing substrate guides extending both upstream and downstream of the conveyance roller along the conveyance path.

Referring to FIGS. 1 and 2, there is shown a system 10 for conveying a substrate 12 along a path. A conveyance roller 14 can make rolling contact with substrate 12 along the cylindrical surface 16 over a wrap angle Θ which is expressed as a central angle from the axis 18 of roller 14. The size of the wrap angle typically is governed by several known process parameters, including tension on the substrate and air pressure difference between the upper and lower surfaces of the substrate.

A serious conveyance problem can arise when the substrate is a discontinuous sheet having a free leading edge, in that there is no tension in the substrate downstream of the roller, as would exist in conveying a continuous web, to aid in unwrapping the substrate from the roller. The sheet is advanced along its path only by its own traction on the roller. Further, when the substrate is physically thin, of the order of 0.001 inches or less in thickness, and when the substrate is electrostatically active, the sheet may not unwrap spontaneously from the roller at a desired point. In fact, the unwrapping of the substrate may be uncontrolled and can result in conveyance failure and a process jam.

Such failure can be prevented in accordance with the invention. Roller 14 is provided with at least one circumferential groove 20, of substantially arbitrary depth and width. Preferably, a plurality of such grooves are provided, spaced apart axially along the length of the roller 14.

Disposed in each groove 20 and extending downstream of said roller and exiting said groove at a predetermined point 22 is a substrate guide 24, also known as a "stripping finger." Guide 24 preferably is not in rubbing contact with either of the walls or bottom of grove 20, but it must extend at least to below the surface level 16 of roller 14. As roller 14 rotates to convey substrate 12 forward, the free forward edge 26 of the substrates encounters guide 24 and is automatically forced out of contact with surface 16 and along the surface 28 of guide 24. That is, the substrate is automatically stripped from the roller at a predetermined location. Wrapping of substrate on the roller beyond this location is thus prevented.

To control the total wrap angle Θ on the roller, it may be desirable to provide additional substrate guides 30 at the entering point 32 of the substrate onto the roller. In one embodiment, this is readily accomplished by extending guide or guides 24 through groove 20 upstream along the conveyance path, as shown in FIG. 2.

Figure 3:
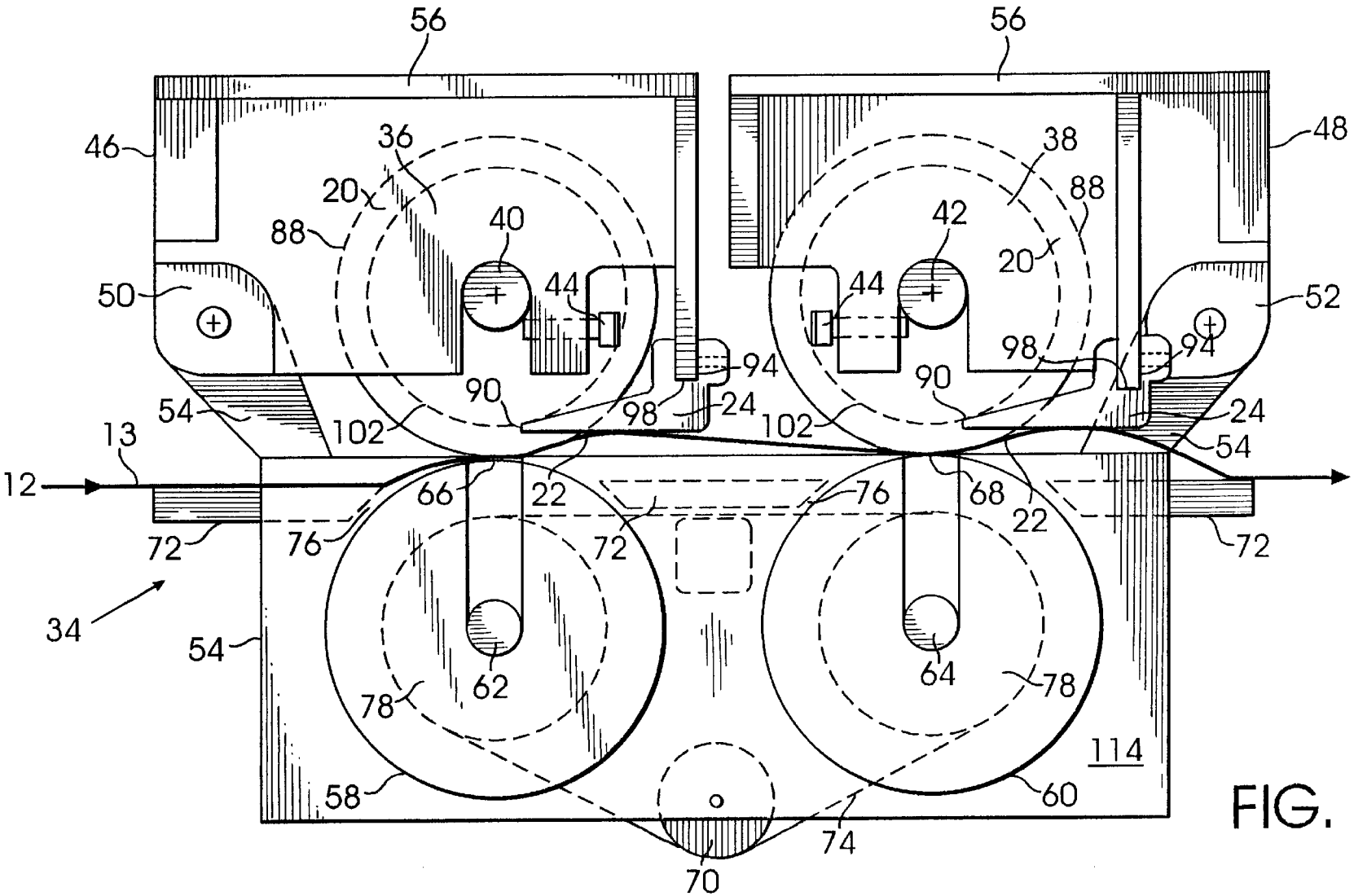
FIG. 3 is an elevational view, partially cross-sectional, of a sheet cleaner system in accordance with the invention.
Figure 4:
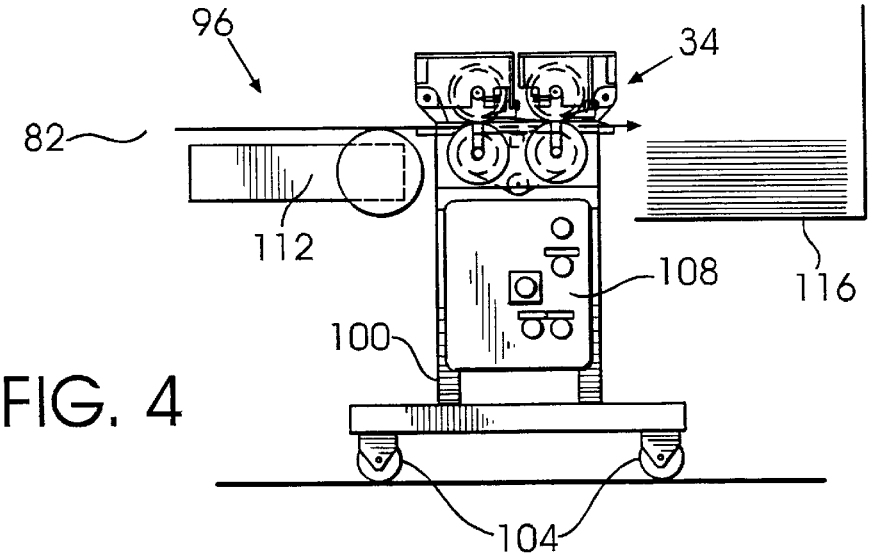
FIG. 4 is a plan view of the system shown in FIG. 3.
Figure 5:
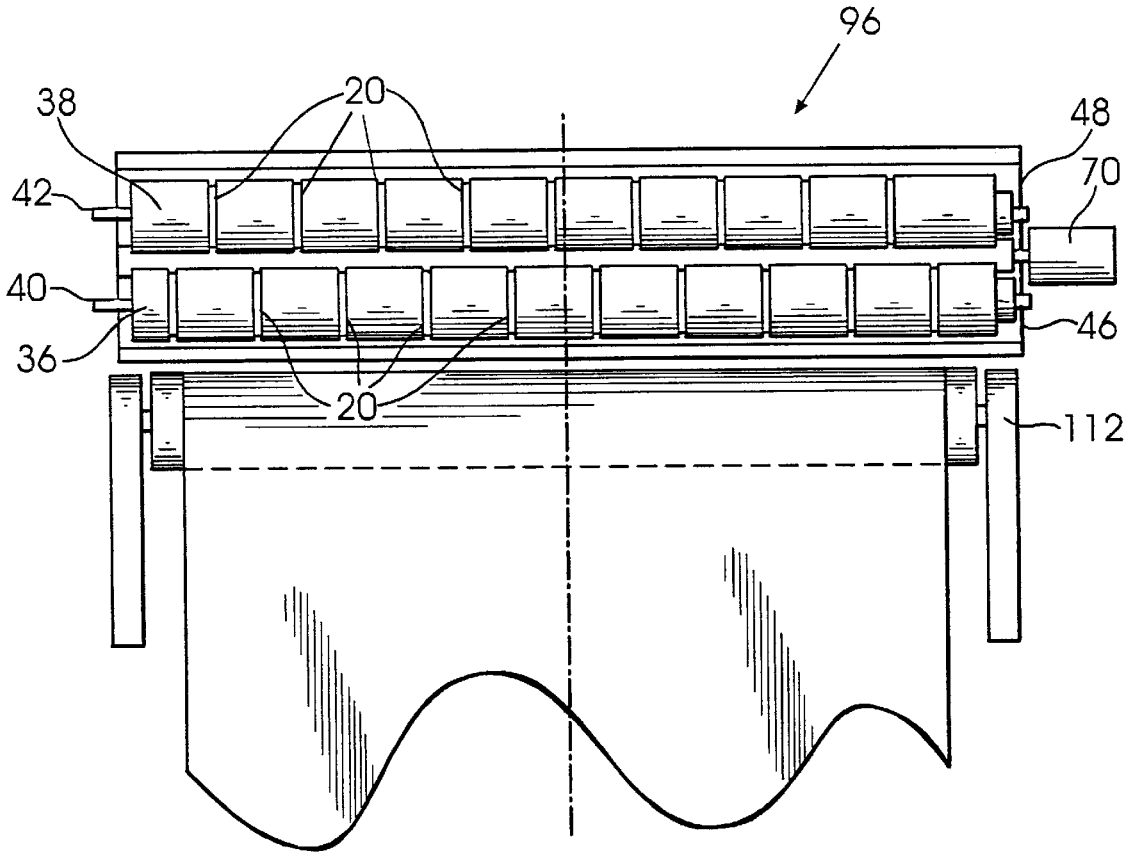
FIG. 5 is an elevational view of a complete portable sheet cleaner apparatus including the system shown in FIG. 3.

Referring to FIGS. 3 through 5, there is shown a system 34 for cleaning one surface of a substrate 12 in accordance with the invention. First and second contact cleaning rollers 36 and 38, respectively, are rotatably mounted in bearings on shafts 40 and 42 which are retained by locking screws 44 in first and second pivotable CCR frames 46 and 48, respectively. The CCRs are of known construction and composition and include a cylindrical shell which includes a resilient polymer, for example a polyurethane, formed on a steel roller. Frames 46 and 48 are adjustably hinged on hinges 50 and 52, respectively, from a fixed frame 54, and may be rotated about 90° to a stop whereby the CCRs may be cleaned or removed. Each hinged frame has a top 56 to shield the CCR from accidental damage and which is preferably transparent to permit visual assessment of the amount of debris collected by the CCR.

First and second backer rollers 58 and 60 include fixed shafts 62 and 64, respectively, which are mounted at their ends in bearings on frame 54.

The relative position of each CCR with respect to its opposed backer roller may be adjustable by adjusting the position of either the CCR bearings or the backer roll bearings in known fashion. Preferably, the hinges 50 and 52 of the pivotable frames are provided with adjustable stops. Preferably, the operating clearance between the CCR and backer roller at first and second nips 66 and 68, respectively, is negative (CCR under slight compression in operation) and is set equal to the thickness of the substrate to be cleaned minus between 0 and 0.040". Typically, the weight of the CCR and its pivotable frame is sufficient to keep the frame against its adjustable stop during operation and thus to insure the desired degree of compression of the CCR. In applications wherein a very light pressure is judged optimum for cleaning, thin bands may be installed around the backer roller or the CCR near both ends of the rollers and outboard of the sheet path. Principal contact between the rollers then occurs at the bands, with reduced contact and pressure between the bands.

Either roller in each pair of CCR/backer rollers may be driven by any convenient known driving means, for example, by a speed-controlled electric motor coupled to the backer roller drive shaft or to a portion of the CCR surface outboard of the cleaning surface. Preferably, each backer roller is driven and the CCRs are idlers, preferably with a single motor 70 coupled by a belt 74 and shivs 78 to both backer rollers 58 and 60 as shown in FIG. 3.

In some applications, a backer roller is not needed, the substrate being wrapped intentionally over a radial wrap angle on the CCR surface. In such applications, the CCR itself may be a driven roller.

A sheet substrate 12 to be cleaned on its upper surface 13 enters the system 34 shown in FIG. 3 at the left side and is supported through the apparatus on a flat bed 72 which is provided with slots 76 parallel with the rollers to receive backer rollers 58 and 60, respectively. Preferably, the plane of bed 72 is slightly below tangential with nips 66 and 68. For heavy or thick substrates, it can be preferred to provide a plurality of through-bores (not shown) in bed 72 normal to the substrate path and a plenum on the underside of 72 connected to a source of compressed air for air-assisted conveyance of the substrate. Sheet substrates readily cleanable are, for example, plastic polymers such as polyolefins, polycarbonates, polyacrylics, polysulfones, and polyamides; papers; metal foils and foil laminates; and glass.

In accordance with the invention, CCRs 36 and 38 are formed with a plurality of circumferential grooves 20 spaced apart axially in the cleaning surface 88 of each roller. Grooves 20 may be evenly or unevenly spaced along the axial length of cleaning surface 88. The grooves in the second CCR are offset axially (inopposed) from those in the first CCR to provide for cleaning of 100% of a substrate surface passing through the system. Into each groove is disposed a substrate guide 24 having a tip 90 and a channel 94 for rigidly mounting guide 24 on a lip 98 of pivotable frame 46/48. The guides 24 act to prevent substrates, particularly thin, electrostatic substrates which may become electrically adhered to the CCR surface 88 as the substrate 12 passes through the nips, from following the CCR surface beyond the point of insertion 22 of the guides 24 into the grooves. Guides 24 preferably are tapered to be about tangential with the bottom 102 of the grooves and to form a shallow angle between the lower surface of the guide and the tangent to the CCR surface. Other shapes of guides 24 may be preferred in specific applications. Guides 24 may be formed of any convenient plastic or metal material having sufficient rigidity and durability and capable of being finished to a polish on surface 110 to minimize drag of the substrate against the guide. Suitable materials are, for example, steel or aluminum, plated or polished; stainless steel; and polymers such as nylon, teflon, acrylics, and polycarbonate.

The sheet cleaning system 34 may be incorporated in, for example, a portable apparatus 96 for inclusion in a production line, as shown in FIGS. 4 and 5. System 34 is supported by a portable frame 100 mounted on castors 104 and containing controls in a control panel 108. Sheets to be cleaned are conveyed from the left 82 by conveyor 112 into the system, and are accumulated after cleaning in a stacker 116.

Figure 6:
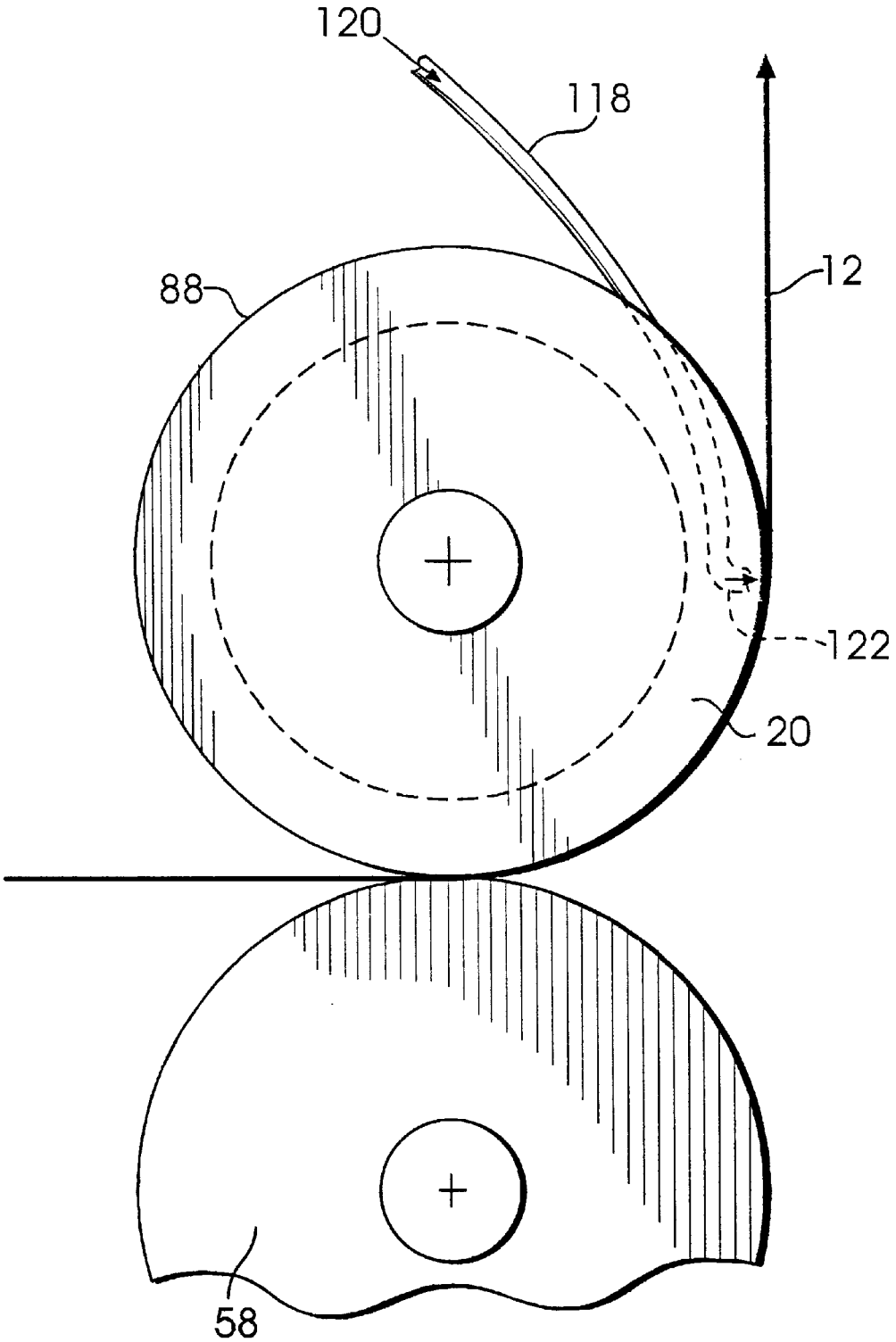
FIG. 6 is a schematic cross-sectional elevational view of another embodiment of the invention, showing the capability of the system for turning a sheet from its direction of entry, and also showing an alternative sheet lifting element (air jet)
Figure 7:
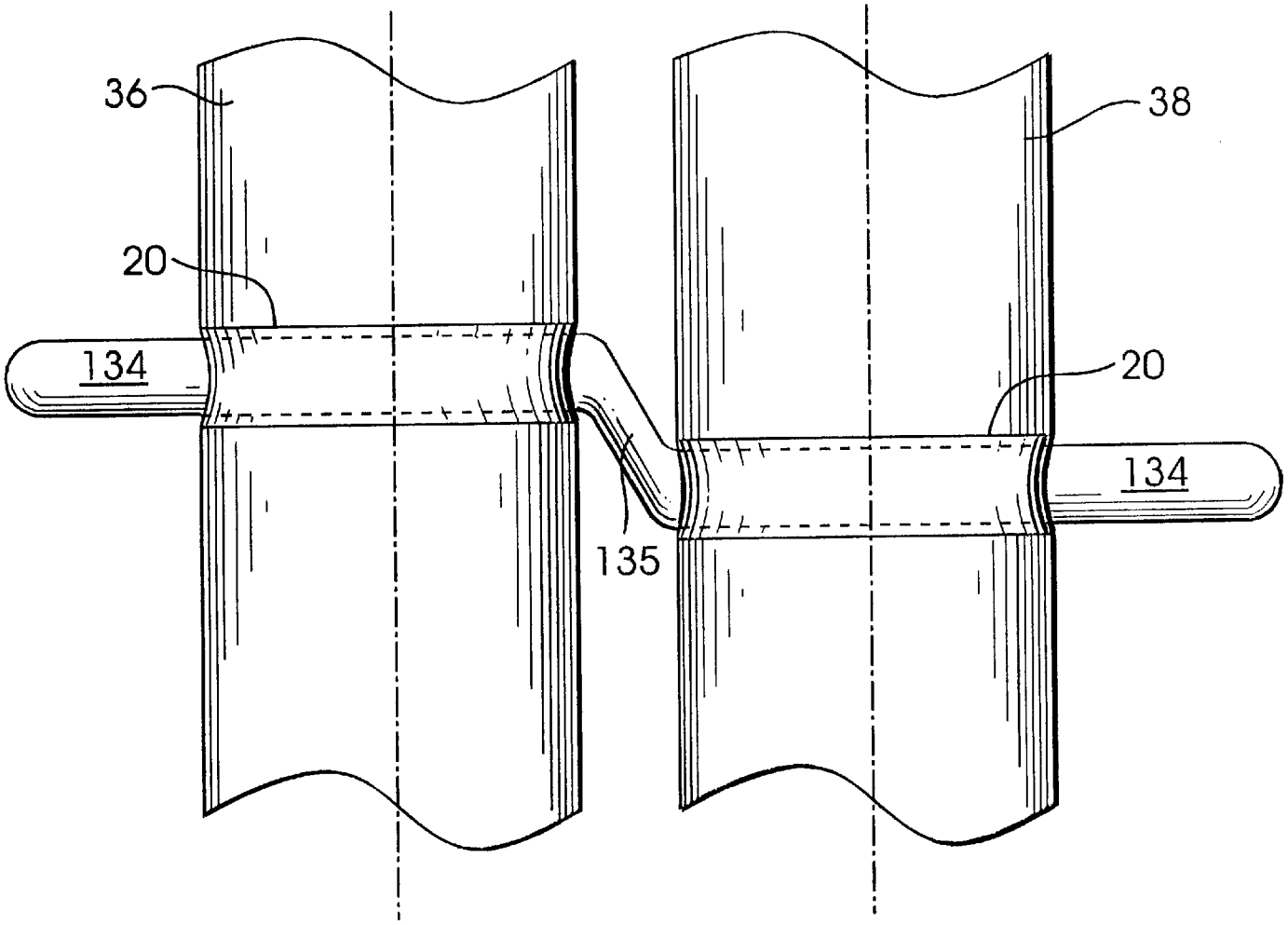
FIG. 7 is a plan view of one embodiment of a substrate guide.
Figure 8:
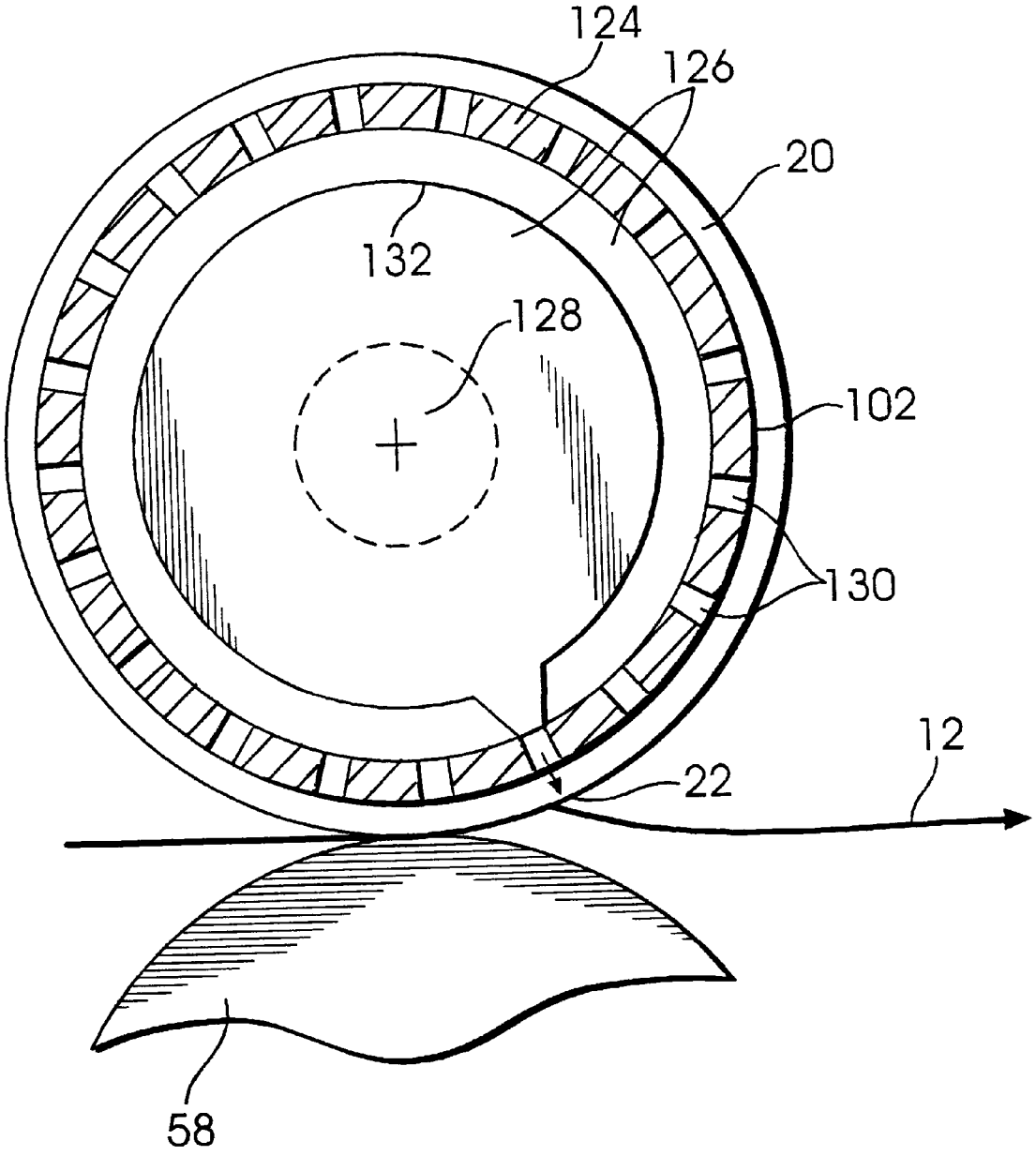
FIG. 8 is a schematic cross-sectional view of another embodiment of the invention including a hollow CCR provided with compressed air and a stationary internal baffle.

Guides 24 are only one embodiment of a substrate guide in accordance with the invention. For example, as shown in FIG. 6, each groove may be provided with a small fixed tube 118 connected to a source of compressed air 120 to deliver a jet of air 122 upwards against the underside of the sheet substrate 12 to force the substrate from the CCR surface. For another example, as shown in FIG. 8, the steel roller 124 of the CCR may be hollow to define a plenum 126 and piped through a rotary coupling 128 to a supply of compressed air, the grooves 20 being provided with a plurality of passageways 130 communicating between the bottom 102 of the grooves and the hollow interior 126 of the roller. A stationary baffle 132 within the roller limits the exposure of high pressure air while the roller is turning to only those passageways 130 oriented at any given time toward the desired radial point of release 22 of the sheet from the CCR surface. For another example, the substrate guides for the first and second CCRs may be formed as a single guide 134 having an offset 135 equal to the aforementioned axial offset between the CCRs, as shown in FIG. 7.

Figure 9:
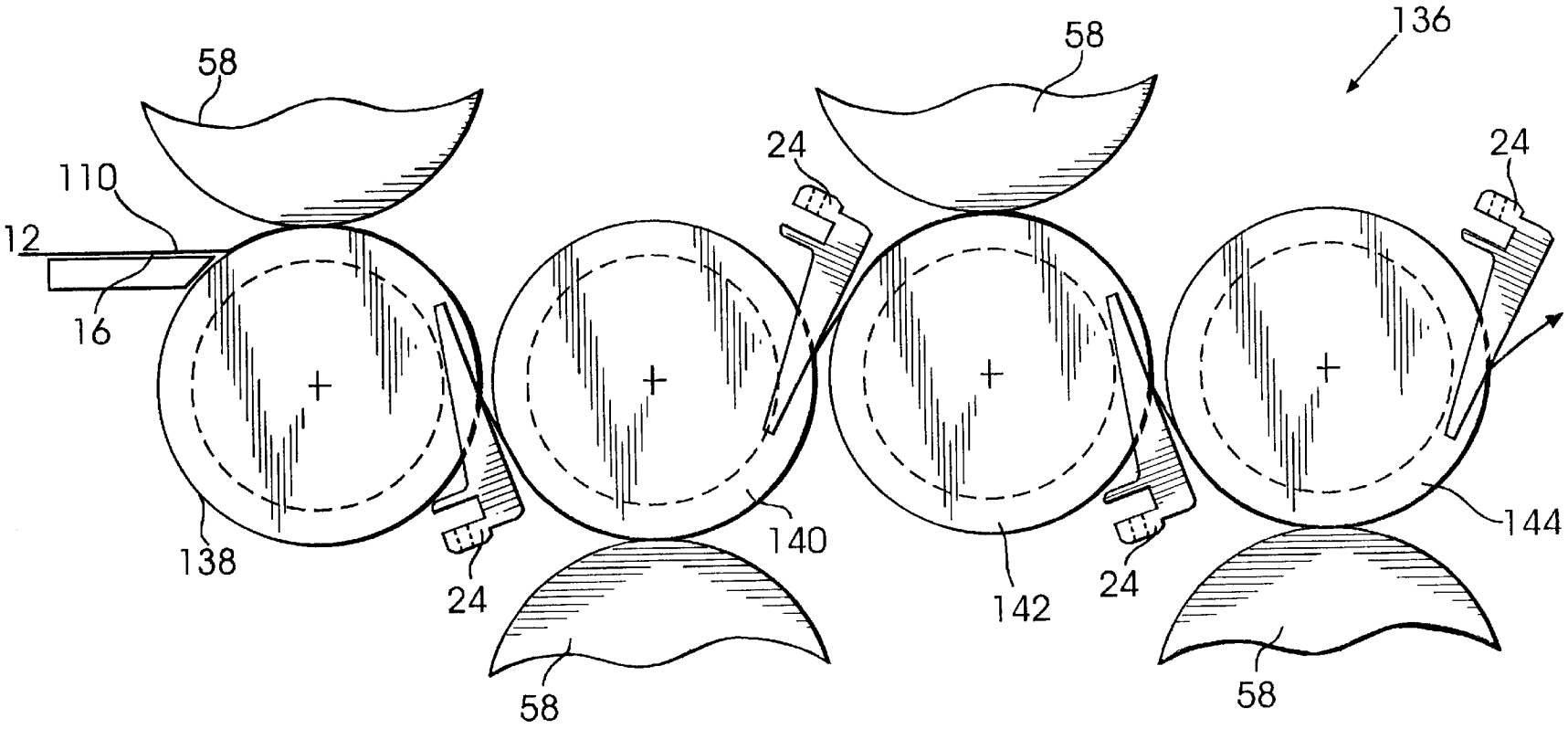
FIG. 9 is a schematic cross-section elevational view of a system in accordance with the invention for cleaning both surfaces of a substrate in a single pass.
Figure 10:
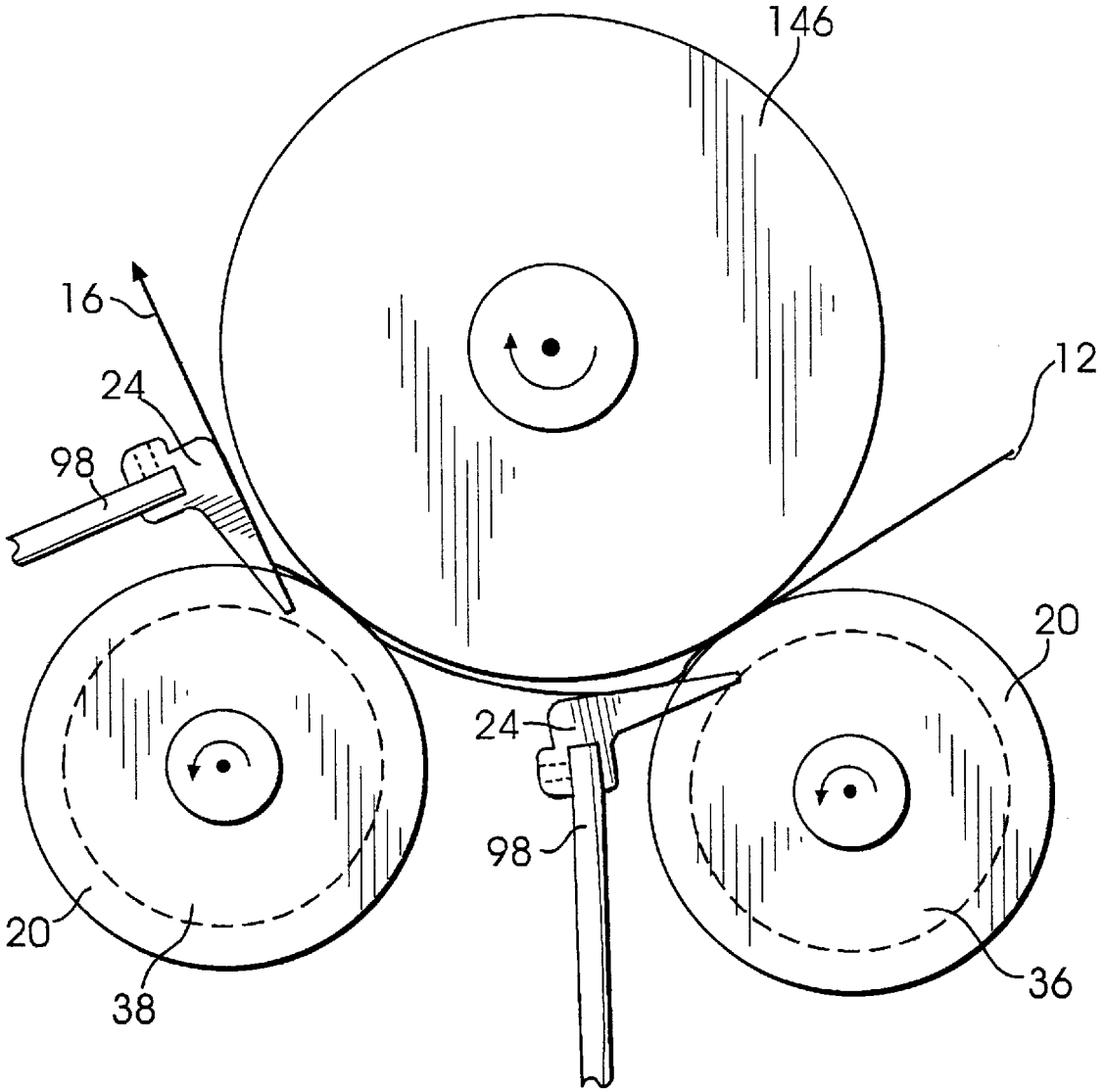
FIG. 10 is a schematic cross-sectional elevational view of another embodiment of the invention showing two contact cleaning rollers sharing a common backing roller.

As shown in FIGS. 9 and 10, a system in accordance with the invention may use to advantage the tendency of thin substrates to stick to a roller surface. If it is desired to direct a substrate in a direction different from the entering direction, the substrate guides 24 may be located at any other radial position of the second CCR up to a turn in excess of 180° from the nip (complete inversion of the sheet). Of course, obvious modification of the pivotable frame 48 is required to permit relocation of the substrate guides at the desired location. Alternatively, the substrate guides may be replaced by fixed air jets as shown in FIG. 6 and discussed above.

The foregoing feature of the system permits considerable flexibility in configuration of cleaning and conveying apparatus. For example, a two-surface cleaner 136 may be configured in a serpentine cleaning path as shown in FIG. 9, wherein the first and third CCRs 138 and 142 are grooved CCRs having axially offset grooves for complete cleaning of a first surface 16 of a substrate 12 and the second and fourth CCRs 140 and 144 are similarly related for complete cleaning of the opposite surface 110 of the substrate. Substrate guides 24 in the grooves lift the sheet 12 from CCR 138 at the appropriate point and transfer it smoothly to the next CCR 140 in the sequence, and similarly to CCRs 142 and 144, thus both surfaces of a flexible sheet substrate may be cleaned in a single handling step.

In another example, two CCRs like 36 and 38 may be disposed in radial separation against a single backer roller 146, as shown in FIG. 10.

The range of thicknesses of substrates cleanable by a system in accordance with the invention is extensive. We have successfully conveyed and-cleaned sheets as thin as 0.00025" (¼ mil) and as thick as several inches, limited only by the maximum throat 114 of the apparatus between the hinges 50/52 and bed 72. (FIG. 3) We have found that the preferred number and axial spacing of grooves in the CCRs is a function of the thickness of the substrate to be cleaned. In general, for substrates between 0.00025 and 0.001 inches in thickness, spacing between grooves may be between 0.5 and 2 inches; for substrates between 0.001 and 0.005 in thickness, spacing may be between 2 and 4 inches; and for substrates between 0.005 and 0.010 inches in thickness, spacing may be between 4 and 5 inches. Substrates thicker than 0.010 inches in general do not tend to require supplementary stripping from CCRs. Depth of the grooves is not critical and may be selected as desired for a particular application.

A CCR cleaner in accordance with the invention may also incorporate the combined entrance and exit guides 24/30 shown in FIGS. 1 and 2. Preferably, the entrance guides 30 are formed with their leading edges 31 turned away from the web path to preclude their being obstructions to the smooth passage of leading edge 26 into nip 66 or 68.

Figure 11:
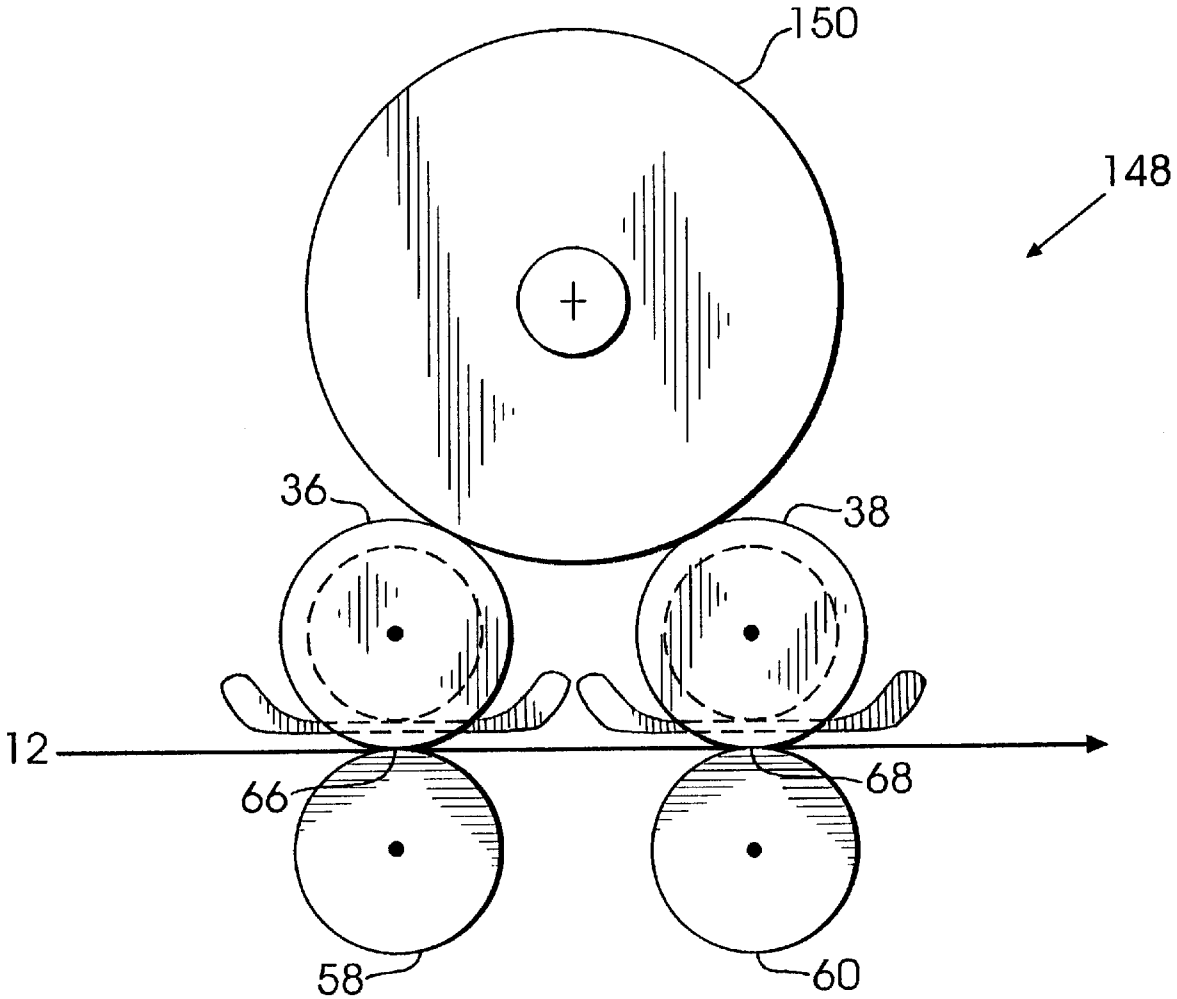
FIG. 11 is a schematic cross-sectional elevational view of still another embodiment of the invention using three CCRs.

Another embodiment 148 of a sheet cleaner in accordance with the invention is shown in FIG. 11. Stripping of thin substrates from the surface of the CCR's is enhanced when the substrate is forced to turn through a short radius of curvature after passing through the cleaning nip. Thus, relatively small-diameter CCR's 36 and 38 may be preferred. They have the additional advantage that the distance between nips 66 and 68 can be reduced, which reduces the potential for misdirection of very thin sheets between the nips and consequent jamming of the apparatus. A disadvantage of providing small-diameter cleaning rollers, however, is the reduction in surface area of the rollers and concomitant reduction in cleaning capacity. As shown in FIG. 11, one solution to this problem is to provide a third and larger-diameter CCR 150, which is non-grooved and is preferably in contact with both the smaller CCR's 36,38 and preferably has higher tack than CCR's 36,38. Thus contaminants removed from the substrate by CCR's 36,38 are in turn transferred to the much-higher capacity CCR 150. In other words, the primary cleaning CCR's are themselves continuously cleaned by a secondary CCR.

Of course, in the apparatus shown in FIG. 11, the backing rollers 58 and 60 may be replaced by another suit of the cleaning apparatus shown above the substrate 12 so that both sides of the substrate may be cleaned simultaneously if so desired.

From the foregoing description it will be apparent that there has been provided an improved system for reliably conveying thin, flexible sheets over rollers wherein fixed substrate guides disposed into circumferential grooves in the rollers limit the wrap assumable by sheets on the rollers, and particular embodiments of this system adapted to cleaning the surface of thin sheet substrates having low sheet stiffness, by using grooved contact cleaning rollers. Variations and modifications of the herein described sheet conveying and cleaning system and in the configuration and combination of grooved rollers, CCRs, backing rollers, and fixed substrate guides in accordance with the invention will undoubtedly suggest themselves to those skilled in this art. Accordingly, the foregoing description should be taken as illustrative and not in a limiting sense.

What is claimed is:

1. A system for cleaning a surface of a thin substrate being advanced along a path, comprising:

a) a first contact cleaning roller having a rotational axis substantially orthogonal to the direction of said advance, said first roller being rotatably disposed to have a cylindrical surface thereof in said path and having a first circumferential groove in said surface;

b) a second contact cleaning roller rotatably disposed in spaced-apart and substantially parallel relationship to said first contact cleaning roller, said second roller having a cylindrical surface thereof disposed in said path and having a second circumferential groove in said surface, said second groove being inopposed relationship to said first groove;

c) a first substrate guide extending into said first groove in said first contact cleaning roller; and d) a second substrate guide extending into said second groove in said second contact cleaning roller.

2. A system in accordance with claim 1 wherein said first guide is connected to said second guide.

3. A system in accordance with claim 1 wherein said first guide is disposed adjacent the leaving point of the substrate from said first roller.

4. A system in accordance with claim 3 wherein said first guide is sufficiently extensive through said groove and along said path to be also disposed in said groove adjacent the entering point of the substrate onto said first roller.

5. A system in accordance with claim 1 wherein said second guide is disposed adjacent the leaving point of the substrate from said second roller.

6. A system in accordance with claim 3 wherein said second guide is sufficiently extensive through said groove and along said path to be disposed adjacent the entering point of the substrate onto said second roller.

7. A system in accordance with claim 1 further comprising a first backing roller rotatably disposed in substantially parallel relationship with said first contact cleaning roller and defining a first nip therebetween.

8. A system in accordance with claim 1 further comprising a second backing roller rotatably disposed in substantially parallel relationship with said second contact cleaning roller and defining a second nip therebetween.

9. A system in accordance with claim 1 further comprising a plurality of circumferential grooves axially spaced apart in the surface of said first contact cleaning roller and a plurality of circumferential grooves axially spaced apart in the surface of said second contact cleaning roller, said grooves in said first roller being inopposed relationship to said grooves in said second roller.

10. A system in accordance with claim 9 further comprising a plurality of first substrate guides, a one of said first substrate guides extending into each of said circumferential grooves in said first contact cleaning roller.

11. A system in accordance with claim 10 wherein said plurality of first substrate guides are commonly connected along the length of said roller.

12. A system in accordance with claim 9 further comprising a plurality of second substrate guides, a one of said second substrate guides extending into each of said circumferential grooves in said second contact cleaning roller.

13. A system in accordance with claim 12 wherein said plurality of second substrate guides are commonly connected along the length of said roller.

14. A system in accordance with claim 1 wherein at least one of said first and second substrate guides is selected from the group consisting of a mechanical finger and an air jet.

15. A system in accordance with claim 1 further comprising a third contact cleaning roller rotatably disposed for rolling contact simultaneously with said first and second contact cleaning rollers and having a greater diameter and higher tackiness than either of said first and second contact cleaning rollers.

* * * * *